United States Patent [19]

Okawa

[11] 4,114,342

[45] Sep. 19, 1978

[54] THERMALLY AND ACOUSTICALLY INSULATING STRUCTURE

[75] Inventor: Taro Okawa, Tokyo, Japan

[73] Assignee: Yoshida Kogyo Kabushiki Kaisha, Tokyo, Japan

[21] Appl. No.: 815,420

[22] Filed: Jul. 13, 1977

[30] Foreign Application Priority Data

Mar. 26, 1977 [JP] Japan ..... 52-36898[U]

[51] Int. Cl.[2] ..... E06B 7/12; E06B 5/20

[52] U.S. Cl. ..... 52/790; 52/171; 52/398; 181/284

[58] Field of Search ..... 52/616, 304, 398, 171, 52/172; 181/284, 285, 290; 428/34

[56] References Cited

U.S. PATENT DOCUMENTS

| | | | |
|---|---|---|---|
| 2,231,514 | 2/1941 | Verhagen | 52/304 |
| 2,291,913 | 8/1942 | Nicolai | 52/398 |
| 2,883,718 | 4/1959 | Persson | 52/398 X |
| 3,343,317 | 9/1967 | Cripe | 52/616 |
| 3,783,084 | 1/1974 | Quenett | 52/616 |
| 3,875,706 | 4/1975 | Okawa | 52/398 X |
| 3,935,683 | 2/1976 | Derner | 52/616 |
| 4,019,295 | 4/1977 | Derner | 52/171 |

FOREIGN PATENT DOCUMENTS

| | | | |
|---|---|---|---|
| 2,261,993 | 2/1974 | France | 52/616 |
| 2,504,293 | 8/1976 | Fed. Rep. of Germany | 52/616 |
| 2,502,264 | 7/1975 | Fed. Rep. of Germany | 52/616 |

*Primary Examiner*—J. Karl Bell

*Attorney, Agent, or Firm*—Wenderoth, Lind & Ponack

[57] ABSTRACT

An improved thermally and acoustically insulating structure provides both a high average acoustical transmission loss for incoming sounds of particularly low frequency range and a thermally insulating and anti-dewing effects. The structure includes at least three glass sheets defining air spaces of different width therebetween, the air enclosed in the spaces circulating therebetween through air passages to be kept dry and at least one air space having means to prevent the effect of Newton's rings of beams of light incident on the outer glass sheet.

8 Claims, 7 Drawing Figures

THERMALLY AND ACOUSTICALLY INSULATING STRUCTURE

BACKGROUND OF THE INVENTION

1. Field of the Invention

This invention relates to a thermally and acoustically insulating structure of the type including a plurality of glass sheets arranged to define air spaces therebetween, more particularly to improved structure which provides both high average acoustical transmission loss and anti-dewing effects, comprising means to make the air in the air spaces circulate therebetween to keep it dry, and means to keep the small spaced sheets away from each other thereby preventing the effect of the so-called Newton's rings.

2. Description of the Prior art

There are known hereto various types of thermally and acoustically insulating structure for use windows or doors. According to one conventional type of structure, there are three sheets of glass arranged to define relatively wide air spaces therebetween, the air spaces containing air drying agents. The structure is designed to insulate incoming sounds of particularly high frequency range and provide a thermal insulating effect. Another known type of structure has at least one relatively small air space between the two adjacent sheets which have the peripheral edges coated with adhesive, thereby absorbing incoming sounds therein. A further different type of construction includes three sheets of glass defining air spaces of a different width therebetween to cut off heat radiation therethrough. A four glass structure has two pairs of outer and inner glass sheets, the inner glass sheets being widely spaced by spacer means and containing an air drying agent in the space. The adjacent inner and outer sheets are less widely spaced and are held in that position by wrapper band. There are other similar types known which have two or more glass sheets spaced identically or differently . All of these known structures have disadvantages and problems. The first cited prior structure containing separate drying agents in the defined air spaces has no means to communicate with the two air spaces for circulating the air therebetween, thus making it necessary to install individual drying agents in the respective air spaces. It is however necessary to provide a very narrow air space between the sheets so as to increase the insulating effect on the incoming sounds of particularly low frequency range, and also to close the air space airtightly from the outside by means of sealant material. However, the above-cited structure and other structures, if the small air space is provided, are not capable of maintaining the air space in a dry condition because of the structural limitation. Furthermore, in cases where the small air space is provided, the opposite glass sheets between the space may become deformed due to wind pressure upon the outer sheet, thus bringing the sheets closer to each other or eventually in contact with each other, which will unavoidably produce the effect of Newton's rings.

OBJECT OF THE INVENTION

In the light of the disadvantages and problems of the above-cited prior structure, it is accordingly, a principal object of the present invention to provide a novel and improved thermally and acoustically insulating structure including three glass sheets having different widths of air spaces therebetween, and which provides both the accoustical insulating effect on particularly low-frequency range sounds or noises and the insulating effect which avoids gathering dew inside and outside due to differential temperatures.

Another object of the present invention is to provide a structure including a relatively wide first air space containing air drying agents therein and a less wide second air space, the two air spaces communicating with each other so that the dry air can circulate between the spaces.

A further object of the present invention is to provide a structure which includes means to keep the opposite sheets between the second air space away from each other so that contact of the sheets due to wind pressure thereupon can be prevented, thus eliminating the effect of Newton's rings that may be produced by light incident on the outer sheet.

A still further object of the present invention is to provide the thermally and acoustically insulating structural assembly in which the intermediate glass sheet has a plurality of apertures through which the dry air can flow between the two air spaces so that the thermal insulating effect can be achieved, thereby ensuring the anti-dewing function under all weather conditions.

BRIEF DESCRIPTION OF THE DRAWINGS

Other objects and advantages of the present invention will become better understood from the following description of the specification and appended claims with an aid of the accompanying drawings, in which:

DESCRIPTION OF THE PREFERRED EMBODIMENTS

The present invention will now be illustrated in further detail by way of examples with reference to the accompanying drawings.

Figure 1:
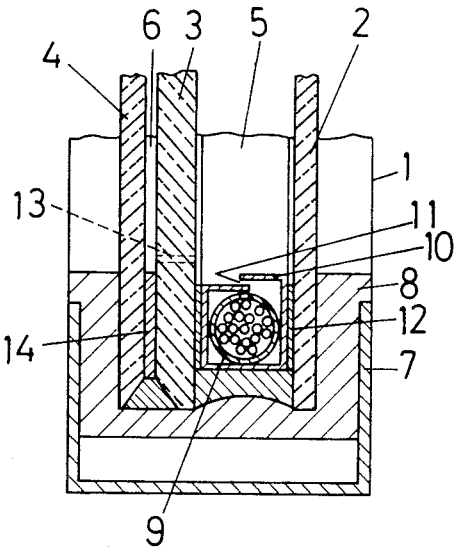
FIG. 1 is a partial sectional view of a preferred embodiment of the invention.
Figure 2:
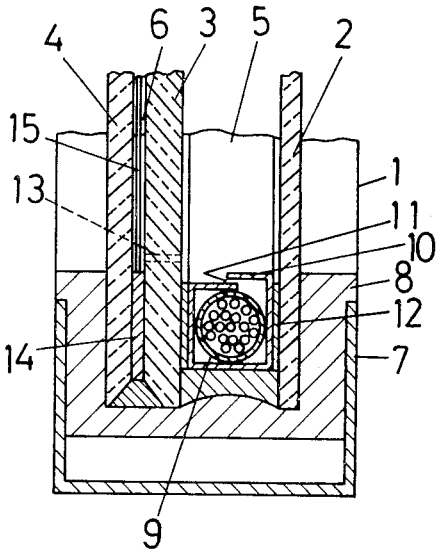
FIG. 2 is a partial sectional view of a varied form of the structure of FIG. 1, including means extending through the second air space for preventing contact of the opposite sheets therebetween.
Figure 3:
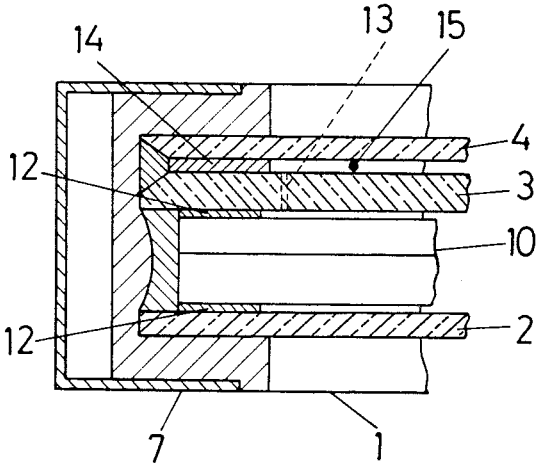
FIG. 3 is a partial sectional plan view of FIG. 2.
Figure 4:
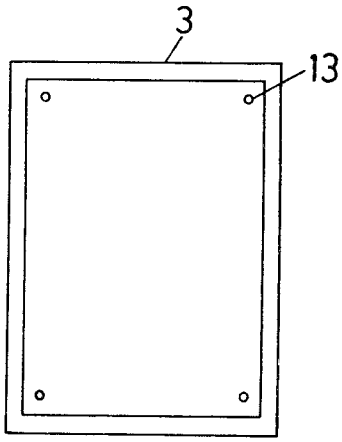
FIG. 4 is a front view of the intermediate glass sheet having apertures at four corners through which the dry air can flow between the two air spaces.

Referring first to FIG. 1, the thermally and acoustically insulating structure according to the present invention essentially includes three sheets of glass of different thickness. FIG. 1 indicates the first embodiment of the invention in which the structure is installed in a building with the relatively wide first air space located on the side of sound or noise source. In FIG. 1, the structure generally designated by 1 comprises a 3 mm thick outer glass sheet 2, a 5 mm thick intermediate glass sheet 3 spaced substantially 6 mm distance away from the outer sheet 2 (the sheets 2 and 3 defining a first air space 5 of 6 mm width therebetween), and a 3 mm thick inner glass sheet 4 spaced 0.2 mm to 0.5 mm away from the intermediate sheet 3 (the sheets 3 and 4 defining a second air space 6 of 0.2 mm to 0.5 mm width therebetween). The sheets 2, 3 and 4 being supported by resilient member 8 such as rubber packing in a metallic frame 7 so that vibration in the sheets are independent of each other when incoming sounds impact and pass through the sheets. As shown in detail in FIG. 1, the first air space 5 includes a spacer member 9 which contains a drying agent 9. More particularly, the spacer member 10 extends circumferentially around the first air space 5 and has an air channel 11 along the length of the upper face thereof through which the drying agent 9 is exposed to act with the air in the air space 5. The gap between the spacer member 10 and the inner sides of the opposite sheets 2 and 3 is circumferentially sealed with sealant material or like substances 12 so that the first air space 5 can be maintained air-tight from the atmosphere. As shown in FIG. 4, the intermediate sheet 3 has, for example, four apertures 13 at its four corners which allow the air in the first and second air spaces 5 and 6 to circulate therebetween. The arrangement, size and number of the apertures 13 are of arbitrary choice, and the essential consideration is the ease with which the air in the spaces 5 and 6 can to flow and circulate through the apertures between the air spaces 5 and 6. The intermediate and outer sheets 3 and 4 defining the second air space 6 have their circumferential edges sealed with sealant 14 or similar material so that the space 6 can be maintained air-tight from the atmosphere. As shown in FIGS. 1, 2 and 3, the sheets 3 and 4 each have a slanted cutout on the inner circumferential edge thereof sealed by adhesive sealant material therein. Provision of this cutout seals the second air space 6 better in cooperation with the sealant 14 in the air space.

The spacer member 10 containing the drying agent 9 therein is per se known, and the drying agent 9 preferably contains synthetic zeolite. The synthetic zeolite has the strong function of absorbing moisture in the air to 0.1 p.p.m., and it is therefore, possible to maintain the two air spaces 5 and 6 in a perfectly dry condition by circulating the thus-dried air through the apertures 13 of the intermediate sheet 3 between the air spaces 5 and 6. The structure shown in FIG. 1 and illustrated hereto is installed with the outer glass 2 on the side of the noise source. FIG. 2 indicates a varied form of the structure in FIG. 1, in which the structure 1 is installed with the inner glass 4 or second air space 6 located on the side of the sound source. As already noted, the second air space 6 is defined by a very small distance (0.2mm to 0.5mm) by the intermediate and inner sheets 3 and 4 and therefore the possibility must be considered that the inner glass 4 may be subjected to strong wind pressure from the outside which may result in deformation of the sheet 4. As a consequence, the sheets 3 and 4 are brought into contact with each other at the deformation points, and eight incident on the sheet 4 deflect itself at the points, with the accompanying effect of Newton's rings making various patterns appear on the sheets 3 and 4. The structure in FIG. 1 has no particular means to prevent this phenomenon, which will be described later; but without such means, it is possible to make the sheets 3 and 4 resist the pressure of wind which amounts to substantially one and half times that which the sheet can resist, because there is dry air of atmospheric pressure air-tightly enclosed in the second and first air spaces.

The varied form of the structure shown in FIG. 2 includes means to eliminate the effect of Newton's rings. Referring to FIG. 2, the structure generally designated by 1 has a construction similar to that in FIG. 1, except that there is provided a Newton's ring preventive means in the second air space 6. According to the modified embodiment of FIG. 2, a plurality of tapes or wires 15, two parallel wires for example shown, extend vertically in the second air space 6 and have both ends thereof secured to the peripheral edges of the opposite sheets 3 and 4 by means of adhesive sealant material. The tapes or wires 15 are preferably made of metallic wire, such as piano wire, or strips of synthetic resin, such as polyester, and have a thickness or diameter smaller than the width of the air space 6 so that they can be extended tightly without contacting the inner surfaces of the opposite sheets 3 and 4. As shown, preferably two parallel tapes or wires are provided for sake of the appearance, but the number and arrangement are not limited to the embodiment shown. The sealant material used to seal the spaces tight between the adjacent sheets is preferably flexible butyl rubber which can maintain the spaces 5 and 6 perfectly air tight from the atmosphere. This airtightness of the spaces prevents the glass from breaking or cracking due to differences in heat expansion which in turn is caused by a difference in the inside and outside temperatures.

In the preferred embodiments illustrated heretofore, the thicknesses of the sheets and the widths of the two air spaces have been given specific values, but those values should be understood to be non-limitative and may be varied properly depending on the surroundings in which the structure according to the invention is installed. In other words, those values should have a range respectively which allow the structure to provide a good accoustical insulating effect on particularly low-frequency range sounds or noises, thereby having an average stably high transmission loss in the low frequency range of 125 to 500 $H_z$.

Figure 5:
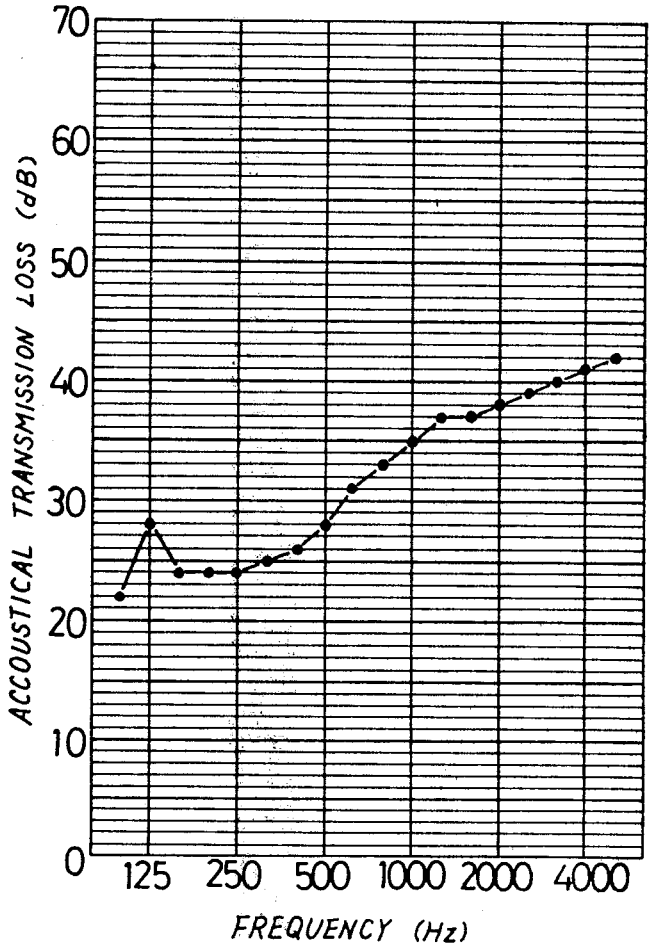
FIG. 5 is a graph of experimental data showing variations of the accoustical transmission loss (dB) with frequency ($H_z$) when the structure of FIG. 1 is installed with the first air space located on the side of the sound source.
Figure 6:
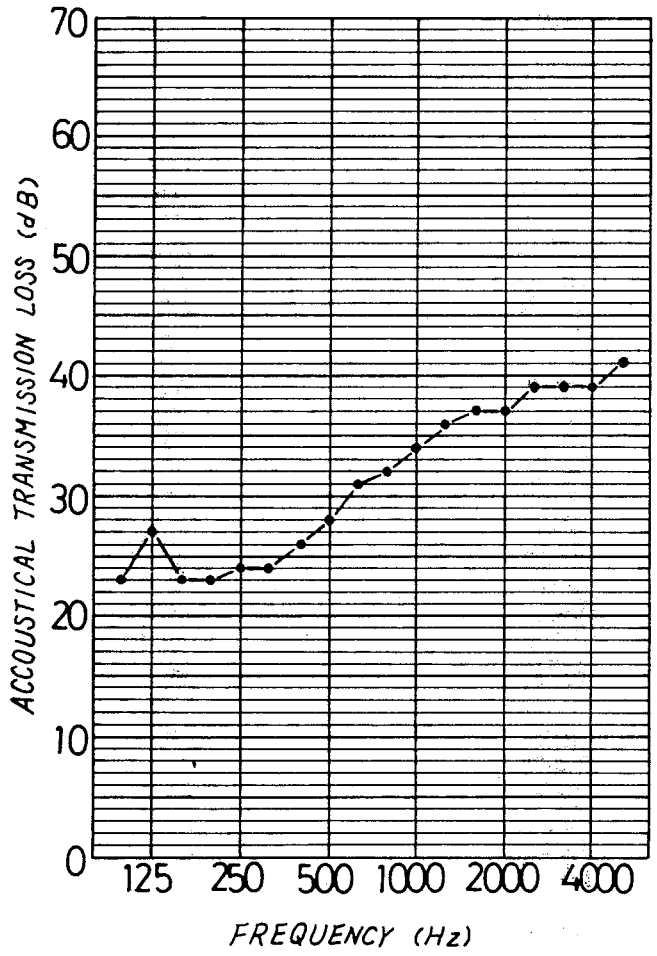
FIG. 6 is a graph of experimental data showing variations of the accoustical transmission loss (dB) with frequency ($H_z$) with the second air space on the sound source.

FIG. 5 indicates experimental data showing variations of the accoustical transmission loss (dB) with frequency ($H_z$), with the first air space located on the side of the sound source, and FIG. 6 indicates experimental data with the second air space on the sound source. The side of the experiment was carried out under the following conditions. The structure according to the invention with an area of glass of 570 mm × 1170 mm was installed in an opening (an area of 4 $m^2$) of a test room (247 $m^3$), and was fixed by way of clay to light-weight concrete block. The sound supply room had a size of 109 $m^3$ and produced sounds of 1/30 act. range. The structure was subjected to tests with the first and second air spaces on the source side. The test room had the ambient temperature and relative humidity of 12° C and 70%.

Figure 7:
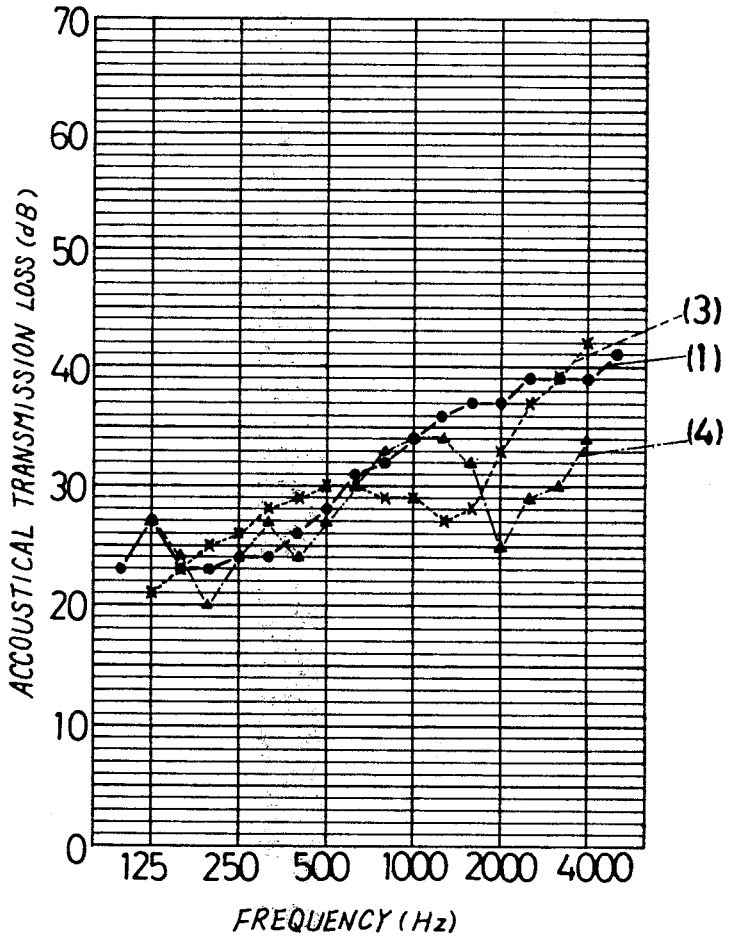
FIG. 7 is a graph of comparative experimental data showing variations of dB with $H_z$ with respect to the two conventional structures and the present invention.

The table below presents values of the transmission loss (dB) varying with frequency of 100 to 5,000 $H_z$ with regard to the invention apparatus and the two conventional structures which have been obtained from the experiments, and those value's are plotted in FIG. 7. FIG. 7 indicates the comparative graphical data when the invention apparatus was installed with the first air space on the source side.

| Frequency ($H_z$) | Acoustical transmission loss (dB) 3-6(*)-5-0.5(*)-3 (mm) (1) | 3-0.5(*)-5-6(*)-3 (mm) (2) | Single glass 10 mm (3) | 6-6(*)-6 (mm) (4) |
|---|---|---|---|---|
| 100 | — | 23 | 19 | — |
| 125 | 23 | 27 | 21 | 27 |
| 160 | 24 | 23 | 23 | 24 |
| 200 | 24 | 23 | 25 | 20 |
| 250 | 24 | 24 | 26 | 24 |
| 315 | 25 | 24 | 28 | 27 |
| 400 | 26 | 26 | 29 | 24 |
| 500 | 28 | 28 | 30 | 27 |
| 630 | 31 | 31 | 30 | 30 |
| 800 | 33 | 32 | 29 | 33 |
| 1,000 | 35 | 34 | 29 | 34 |
| 1,250 | 37 | 36 | 27 | 34 |
| 1,600 | 37 | 37 | 28 | 32 |
| 2,000 | 36 | 37 | 33 | 25 |
| 2,500 | 39 | 39 | 37 | 29 |
| 3,150 | 40 | 39 | 39 | 30 |
| 4,000 | 41 | 39 | 42 | 34 |
| 5,000 | 42 | 41 | — | — |

Remarks:
*: air space (1) and (2): inventions, (3) and (4): conventional

The invention had an average transmission loss of 27 dB in the frequency range of 125 to 500 Hz while the single sheet had an average value of 26 dB and the two sheet structure (6 mm - 6 mm - 6 mm) had an average value of 24 dB. In the frequency range of 315 to 5,000 $H_z$, the invention had an average of 35 dB as opposed to 32 dB and 30 dB, respectively. As noted, the invention is superior to the 6 - 6 - 6 (mm) structure in respect of the thermal insulation, and is superior to the single sheet in respect of the sound insulation.

It is readily understood from the foregoing description that the present invention has numerous merits and advantqges in respect of both thermal and acoustical insulation, because the dry air in the two air spaces can be made to circulate and flow through apertures on the intermediate sheet between the spaces, thereby cutting off the thermal energy passing through glass in the first air space and thus eliminating formation of dew on the glass surfaces due to the differential temperatures between the inside and outside. Furthermore, the present invention has an increased transmission loss by absorbing the sound in the second air space. The effect of Newton's rings due to the contact of the closely spaced sheets which is caused by deformation of glass under strong wind pressure is eliminated by maintaining the air in the second air space in an always dry state thereby making the outer sheet highly resistant to the wind pressure thereon, and preferably by interposing piano wires across the second air space. The formation of dew on the inner surfaces of the glass sheets is eliminated down to the atmosphere temperatures of −49° C, when the structure shown in FIG. 1 has the arrangement of 3 mm thick outer sheet — 6 mm wide first air space — 3 mm thick intermediate sheet, while it is eliminated down to −65° C when the arrangement includes 5 mm thick outer sheet — 6 mm wide air space — 5 mm thick intermediate sheet.

Although the invention has been described by way of the several preferred embodiments thereof, it should be understood that various changes and modifications may be made without departing from the spirit and scope of the invention.

What is claimed is:

1. A thermally and acoustically insulative structure comprising:

a glazing frame;

a first sheet of glass sealed around all sides into said glazing frame;

a second sheet of glass sealed along all sides into said glazng frame parallel to and spaced from said first sheet, the space between said first and second sheets defining a first airtight space;

a third sheet of glass sealed along all of its edges into said glazing frame parallel to and spaced from said second sheet, the space between said second and third sheets defining a second air space;

said second air space being a micro-air space defined by a very small distance between said second and third sheets;

said first air space being substantially wider than said second micro air space;

communication means in said second sheet open to said first and second air spaces for communicating said first and second air spaces with each other; and contact-preventing means extending between and spaced from said second and third sheets in said second micro air space for preventing said second and third sheets from contacting each other due to wind deformation and for preventing the formation of Newton's Rings.

2. A structure as claimed in claim 1, wherein said communication means is a plurality of openings at the corners of said second sheet open between said first and second air spaces.

3. A structure as claimed in claim 1, wherein said contact-preventing means is comprised of a plurality of parallel, spaced strips spaced between said second and third glass sheets.

4. A structure as claimed in claim 3, wherein said strips are comprised of piano wire.

5. A structure as claimed in claim 3, wherein said strips are comprised of polyester wire.

6. A structure as claimed in claim 1, wherein said second micro air space is substantially 0.2 mm to 0.5 mm wide.

7. A structure as claimed in claim 6, wherein said first air space is 6 mm wide.

8. A structure as claimed in claim 1, wherein:

said second and third sheets defining said second micro air space have slanted surfaces facing each other around the inner peripheral edges thereof; and sealing material is filled into the space between said facing slant surfaces of said second and third sheets.

* * * * *